US011788176B2

(12) United States Patent
Skrlec et al.

(10) Patent No.: US 11,788,176 B2
(45) Date of Patent: Oct. 17, 2023

(54) STEEL FOR MANUFACTURING A COMPONENT BY HOT FORMING AND USE OF THE COMPONENT

(71) Applicant: OUTOKUMPU OYJ, Helsinki (FI)

(72) Inventors: Jasminko Skrlec, Duisburg (DE); Stefan Lindner, Willich (DE)

(73) Assignee: OUTOKUMPU OYJ, Helsinki (FI)

( * ) Notice: Subject to any disclaimer, the term of this patent is extended or adjusted under 35 U.S.C. 154(b) by 212 days.

(21) Appl. No.: 16/482,828

(22) PCT Filed: Feb. 5, 2018

(86) PCT No.: PCT/EP2018/052818

§ 371 (c)(1),
(2) Date: Aug. 1, 2019

(87) PCT Pub. No.: WO2018/146050

PCT Pub. Date: Aug. 16, 2018

(65) Prior Publication Data

US 2019/0352755 A1 Nov. 21, 2019

(30) Foreign Application Priority Data

Feb. 10, 2017 (EP) ..... 17155557

(51) Int. Cl.

| | |
|---|---|
| ***C22C 38/38*** | (2006.01) |
| ***C22C 38/58*** | (2006.01) |
| ***C21D 6/00*** | (2006.01) |
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/26*** | (2006.01) |
| ***C22C 38/48*** | (2006.01) |
| ***C21D 9/08*** | (2006.01) |

(52) U.S. Cl.

CPC ..... *C22C 38/58* (2013.01); *C21D 6/002* (2013.01); *C21D 8/0205* (2013.01); *C21D 8/0247* (2013.01); *C21D 9/08* (2013.01); *C21D 9/46* (2013.01); *C22C 38/001* (2013.01); *C22C 38/02* (2013.01); *C22C 38/26* (2013.01); *C22C 38/38* (2013.01); *C22C 38/48* (2013.01); *C21D 2211/001* (2013.01); *C21D 2211/005* (2013.01); *C21D 2211/008* (2013.01)

(58) Field of Classification Search

CPC ..... C22C 38/001; C22C 38/02; C22C 38/04; C22C 38/06; C22C 38/08; C22C 38/38; C22C 38/40; C21D 2211/001; C21D 2211/008; C21D 6/002; C21D 6/004; C21D 9/46

See application file for complete search history.

(56) References Cited

U.S. PATENT DOCUMENTS

2017/0268076 A1* 9/2017 Talonen ..... C22C 38/02

FOREIGN PATENT DOCUMENTS

| | | | |
|---|---|---|---|
| EP | 1106706 | A1 | 6/2001 |
| EP | 1203830 | A2 | 5/2002 |
| EP | 2581465 | A1 | 4/2013 |
| EP | 3029170 | A1 | 6/2016 |
| JP | 2009030128 | A * | 2/2009 |

OTHER PUBLICATIONS

English Translation of JP2009030128 from EPO dated Apr. 18, 2022 (Year: 2022).*

JP 2009-030128 A, Hamada et al. English translation form EPO dated Jun. 4, 2022 (6 pages) (Year: 2022).*

International Search Report issued by the European Patent Office acting as the International Searching Authority in relation to International Application No. PCT/EP2018/052818 dated Mar. 12, 2018 (4 pages).

Written Opinion of the International Searching Authority issued by the European Patent Office acting as the International Searching Authority in relation to International Application No. PCT/EP2018/052818 dated Mar. 12, 2018 (11 pages).

* cited by examiner

*Primary Examiner* — Adam Krupicka
(74) *Attorney, Agent, or Firm* — Quinn IP Law

(57) ABSTRACT

A steel for manufacturing a component by hot forming after austenization includes in weight % less than or equal to 0.2%, carbon (C), less than or equal to 3.5% silicon (Si), 1.5-16.0% manganese (Mn), 8.0-14.0% chromium (Cr), less than or equal to 6.0% nickel (Ni), less than or equal to 1.0% nitrogen (N), less than or equal to 1.2% niobium (Nb) linked to the formula Nb=4x(C+N), less than or equal to 1.2% titanium (Ti) so that Ti=4x(C+N)+0.15, and optionally less than or equal to 2.0% molybdenum (Mo), less than or equal to 0.15% vanadium (V), less than or equal to 2.0% copper (Cu), less than 0.2% aluminum (Al), less than or equal to 0.05% boron (B), the rest being iron and evitable impurities.

12 Claims, No Drawings

STEEL FOR MANUFACTURING A COMPONENT BY HOT FORMING AND USE OF THE COMPONENT

CROSS-REFERENCE TO RELATED APPLICATIONS

This application is a national phase entry under 35 U.S.C. 371 of PCT International Application No. PCT/EP2018/052818 filed Feb. 5, 2018, which claims priority to European Patent Application No. 17155557.6, filed Feb. 10, 2017, the disclosure of each of these applications is expressly incorporated herein by reference in their entirety.

The present invention relates to a steel, preferably to a stainless steel for manufacturing a component by hot forming. The invention also relates to a use of the component.

The hot forming process or often called press-hardening enables together with hot formable materials to reach $CO_2$ emission targets of automotive industry, to practice active lightweight and at the same time to increase passenger safety. Hot forming is defined as a process during which a suitable steel sheet with ferritic or martensitic microstructure is heated up to and held at austenization temperature for a define through hardening time. Thereafter, a quenching process step is followed with a defined cooling rate. Furthermore, the process includes a removal of material out of the furnace and the transfer of material into a hot forming tool. In the tool the material is formed to the target component. Depending on the material composition, the tool must be cooled actively. The cooling rate is oriented to values, which generate martensitic hardening structure for the material. A component manufactured with such a process disposes high tensile strength with mostly low ductility and low energy absorption potential. This kind of component is used for safety and crash-relevant components in passenger car pillars, channels, seat cross-member or a rocker panel.

Heat treatable steels, such as 22MnB5 alloyed with manganese and boron, are used for hot forming in the automotive industry. This alloy reaches after press hardening mechanical properties, like 1050 MPa yield strength, 1500 MPa tensile strength with elongation of fracture $A_{80}$=5-6%, when the material thickness is 1.5 millimeter, the austenization temperature 925° C., the holding time 6 minutes and the defined cooling rate 27 K/s and further the transfer time from the furnace to the hot forming tool 7 up to 10 seconds.

The initial microstructure for hot forming is ferritic or ferritic martensitic and the microstructure is transferred by hot forming into a martensitic hardening structure. Other kinds of the microstructure transformation are only adjusted, if other mechanical properties are required, for some components partially or only locally. Then heating-up or cooling-down rates are varied. Other developments to vary the microstructure are known in the literature as tailored tempering.

The components manufactured by hot forming in the prior art exhibit a high hardness and respectively a high tensile strength but a low elongation. Therefore, drawbacks are then a low ductility, a brittle fracture behavior as well as a brittle component failure combined with low notch impact strength and particularly a low energy absorption potential under abrupt, dynamic, cyclic and ballistic load. Beside high energy absorption a low intrusion level for safety relevant crash parts is required concurrently. Furthermore, the materials offer after hot forming an insufficient bendability, what eliminates the option of post-processing the components by cold-forming operations. In addition, a hot-trim under martensitic starting temperature ($M_s$), for instance for the steel 22MnB5 between 390° C. and 415° C. depending on the calculation rule, is only restrictively possible for the heat-treatable steels of the prior art. As a further drawback for the process stability of such materials during hot forming, the property of being a non-air-hardening steel can be pointed out. That means that a critical cooling rate must be mandatory observed to reach the full-converted hardening structure. This has to be adopted from the hot forming tool by coolant passages, what makes the tool clearly more expensive. Moreover, the tool coating must be respectively configured. Otherwise in the case of an up-heated tool during clock frequency, even if only locally, softer parts with a ferritic, bainitic or pearlitic microstructure arise and change the resulting component properties in a negative manner, i.e. not having required strength or hardness of a crash-relevant component. During the cooling-down process the martensitic finish temperature $M_f$ must be undercut, before the removal of the component from the hot forming tool is possible. That is necessary to ensure a completely martensitic transformation. But this restriction results in a significant cycle time reduction and is therefore a major economic drawback in comparison with cold-forming manufacturing.

A further drawback is the necessity of an additional surface coating to protect the material against scaling during hot-forming and corrosion during the component life-time. The heat-treatable steels do not fulfill the corrosion requirements, especially wet corrosion in passenger cars because of their alloying system. The layer of scales cannot endure during further component processing and life-time. To bypass the drawbacks of a blanked surface the WO publication 2005/021822 describes a cathodic corrosion system on the basis of zinc and magnesium. In contrast, the WO publication 2011/023418 works out an active corrosion protection system with zinc and nickel. Furthermore, a surface coating with zinc and aluminum is known from the EP publication 1143029, and the EP publication 1013785 defines a scale-resistant surface coating on the basis of aluminum and silicon. An organic matrix with particles on the basis of $SiO_2$ is mentioned in the WO publication 2006/040030. In all types of those coatings the layer thickness is adjusted from 8 up to 35 micrometer. Further, all those coatings have a limited temperature stability during hot-forming process that results on one side in a limited process window for hot-forming and on another side in the danger of an unwanted melting of the coating during the austenization process. The last aspect results in damage cases with roll-breakages in the roller hearth furnaces because of contamination of the ceramic rollers with liquid phases of the surface coating. For some coatings a defined moderate up-heating curve is necessary to built up a heat resistant interlayer because of diffusion processes in the first step and then to go on with the considering hot-forming process. Therefore, cost efficient and emission efficient fast-heating technologies with inductive or conductive methods cannot be used up to now.

The heat-treatable steels used in the prior art for hot-forming and the surface coatings of these steels show further significant drawbacks in their weldability. For thermal joining processes of the heat-treatable steels, a general softening can be detected in the heat-affected zone (HAZ). In general the alloying elements of the heat-treatable steels, such as carbon or boron, counteract the weldability. Furthermore, the high strength properties cause an increased danger for hydrogen embrittlement and then also higher stresses exist. The stresses collaborate with the martensitic hardening structure and hydrogen absorption. The absorption of hydrogen can have its origin in the furnace process because of a dew point underrun during hot-forming or because of welding during processing the hardened component. Because of melt phases during welding, elements from the surface coating, such as aluminum or silicon can be inserted into the weld seam. The results are brittle, strength-reducing, intermetallic AlFe or AlFeSi phases. On the contrary, if the surface coatings are zinc-based, low-melting zinc phases result during welding and affect to cracks because of liquid metal embrittlement.

Further developments target to decouple the hardening and the forming process. In a first step a so-called preconditioning austenises and quenches a strip or a sheet instead of a press hardening with a partially martensitic transformation microstructure. In a subsequent step the strip or sheet can be formed to a component with a temperature under $A_{C1}$ transformation temperature. The US publication 2015047753A1 and the DE publication 102016201237A1 describe such an alternative process way to save $CO_2$-emissions during component manufacturing.

The WO publication 2010/149561 refers to stainless steels as a material group for hot-forming. Ferritic stainless steels, such as 1.4003, ferritic martensitic stainless steels, such as 1.4006 and martensitic stainless steels, such as 1.4028 or 1.4034, are pointed out. As a special form the up to 6 weight % nickel alloyed martensitic stainless steels are mentioned. The alloying element nickel increases the corrosion protection and operates as an austenite phase former. The general advantage of having air-hardening properties is described in this WO publication 2010/149561 for these stainless steels. The reachable hardness after hot-forming is related to the level of the carbon content. A distinction is made for the level of the austenization temperature in relation to the forming degree, high degrees of forming in austenization temperature above $A_{c3}$ are recommended to prevent a negative influence of precipitated carbides. The drawbacks of those hot-formable stainless steels are first of all the high austenization temperature, for instance for 1.4304 at 1150° C. Such temperatures mostly exceed the possibilities of furnaces used for automotive hot-formed components. To reach a high ductility level, a subsequent annealing process is necessary and it reduces the economic efficiency. Furthermore, the martensitic stainless steels with carbon content more than 0.4 weight % are classified as non-weldable in general. The high carbon content results during welding typical cooling rates to a structural transformation with a high tendency for hardening cracks and an embrittlement of the heat-affected zone. The high carbon content in relation to chromium affects in a significant reduced resistance against intergranular corrosion after welding in the heat-sensitized zones. Further, below temperatures for solution annealing which are alloyed-depended for this material group between 400 and 800° C., a local depletion zone can be detected because of segregation of chromium-concentrated carbides, such as $Cr_{23}C_6$. The nucleus formation on the grain boundaries is facilitated in relation to areas with the grain. For a combination of chemical and mechanical loads, stress corrosion cracking with an intergranular crack path can be resulted.

The object of the present invention is to eliminate some drawbacks of the prior art and to achieve an improved steel, preferably a stainless steel to be used for manufacturing by hot forming process a component with high strength, high elongation and ductility. The essential features of the present invention are enlisted in the appended claims.

In accordance with the present invention a steel to be used in a hot forming process is a press hardening steel with a defined multi-phase microstructure whereby a defined austenite content after hot-forming is desired to enable good ductility, energy absorption and bendability. The steel has a fine-grained microstructure with homogeneously allocated fine carbides and nitrides. In the hot forming process a reduced austenization temperature and a higher scaling resistance compared to the prior art are utilized. An additional surface coating or additional surface treatments after hot-forming like a sandblast or shot blasting are not necessary because of the natural repassivation by means of chromium oxide (CrO) passive layer. The alloying elements are balanced to each other in a way that a high weldability is performed for the produced hot formed components. Moreover, the martensitic starting temperature $M_S$ is reduced significantly to enable a higher process reliability with a longer time period for hot trim processes and a reduced quenching time in the forming tool. The steels of the present invention are air hardening materials. The combination of a reduced martensitic starting temperature and the property to be an air hardening material results in bigger process windows and in a higher stability of the mechanical values and microstructure for the hot-forming-component manufacturing. The austenization temperature is also reduced to save carbon dioxide ($CO_2$) emissions and energy costs during the hot-forming process. Further, during the life cycle of the component manufactured of the steel of invention, a satisfactory anticorrosive effect is available. In order to achieve a component with high safety, a defined residual austenite content is adjusted by the combination of the material manufacturing and hot forming process independent from the initial material microstructure before hot-forming. The residual austenite content enables a high ductility and therefore a high energy absorption potential under deformation loads.

The steel in accordance with the present invention consists of in weight % less than or equal to 0.2%, preferably 0.08-0.18% carbon (C), less than or equal to 3.5%, preferably less than or equal to 2.0% silicon (Si), 1.5-16.0%, preferably 2.0-7.0% manganese (Mn), 8.0-14.0%, preferably 9.5-12.5% chromium (Cr), less than or equal to 6.0%, preferably less than or equal to 0.8% nickel (Ni), less than or equal to 1.0%, preferably less than or equal to 0.05-0.6% nitrogen (N), less than or equal to 1.2%, preferably 0.08-0.25% niobium (Nb) so that Nb=4x(C+N), less than or equal to 1.2%, preferably 0.3-0.4% titanium (Ti) so that Ti=4x(C+N)+0.15 or preferably Ti=48/12% C+48/14% N, and further optionally less than or equal to 2.0%, preferably 0.5-0.7% molybdenum (Mo), less than or equal to 0.15% vanadium (V), less than or equal to 2.0% copper (Cu), less than 0.2% aluminum (Al), less than or equal to 0.05% boron (B), the rest being iron and evitable impurities occupying in stainless steels.

The effect of the elements alloying in the steel of the invention is described in the following:

Chromium creates a chromium oxide passivation layer on the surface of the steel object and achieves thus a fundamental corrosion resistance. The ability for scaling will be substantially depreciated. Therefore, the steel of the invention does not require any further corrosion or scaling protection, such as a separate surface coating for the hot forming process as well as for the component life-time. Further, chromium restricts the solubility of carbon what results a positive effect for the creation of the residual austenite phase. Chromium also improves the mechanical property values, and chromium makes effect in a way that the steel of the invention appears as an air-hardener for the thickness range lower than 10 millimeter. An upper limitation of the chromium content is the result of the surcharge and the microstructure equilibrium, because chromium is a ferrite phase former. With increased chromium content the austenization temperature increases in an unsuitable manner, because the austenite phase range of the steel of the invention is reduced. The chromium content is thus 8.0-14.0%, preferably 9.5-12.5%.

The austenite phase area which was reduced by chromium, can be at least partly avoided by carbon, because carbon is an austenite phase former. At the same time the carbon content is necessary for the hardness of the resulting microstructure after the hot forming process. Together with the other austenite phase forming elements, carbon is responsible for stabilizing and extending the austenite (γ) phase area during hot forming above the austenization temperature so that the microstructure produced is saturated with the austenite phase. After the cooling-down process from hot forming temperature down to room temperature, ductile austenitic areas are existing in a high strength martensitic matrix. If it is desirable to transform the residual austenite into martensite again, a cryogen treatment or cold forming operations, such as peeling, are possible to perform. An upper limitation of the carbon content is enable for high weldability and acts against the danger of intergranular corrosion after welding in the heat-affected zones. A too high carbon content will increase the hardness of martensite phase after welding and, therefore, the carbon content increases the cracking susceptibility for stress-induced cold cracks. Further, with a desired carbon content, preheating process before welding can be avoided. Therefore, the carbon content is less than or equal to 0.2%, preferably 0.08-0.18%.

Nitrogen is a strong austenite phase former, as well as carbon, and thus the carbon content can be upper-limited because of addition of nitrogen. As a result the combination of hardness and weldability can be achieved. Together with chromium and molybdenum, nitrogen improves the corrosion resistance for crevice corrosion and pitting corrosion. Due to the fact that the solubility of carbon is limited with the increasing chromium content, nitrogen can be inversed more solved with higher chromium contents. With the combination of the sum (C+N) in connection with chromium, a well-balanced ratio of increased hardness and corrosion protection can be reached. The upper limitation of nitrogen results in a limitation of the suitable residual austenite phase amount and in the limited possibility to dissolve nitrogen in industrial-scale melting. Further, the too high nitrogen content disables all kinds of segregations which cannot dissolve nitrogen. One example is the undesirable sigma phase which is especially critical during welding, and also the carbide $Cr_{23}C_6$ is accountable for intergranular corrosion.

The addition of niobium into the steel of the invention results in grain refinement and further niobium results in a segregation of fine carbides. During the component life-time the hot formed steel of the invention shows thus a high brittle fracture insensibility and impact resistance and also after welding in the heat-affected zones. Niobium stabilizes, like titanium, the carbon content and thus niobium prevents the increase of $Cr_{23}C_6$ carbide and the danger of the intergranular corrosion. Thus the temperature-affected sensitization, for example, after welding of the hot formed component, will become uncritical. On the contrary to titanium or vanadium, niobium takes the great effect for fine-grain-hardening and increases thus the yield strength. Further, niobium decreases the transition temperature in the most effective manner in comparison to other alloying elements. And niobium improves the resistance for stress corrosion. In addition to niobium, vanadium is alloyed having the content of less than 0.15%. Vanadium increases the effect of grain refinement and makes the steel of the invention more insensitive against overheating. Further, niobium and vanadium delay the recrystallization during the hot forming process and results in a fine-grain microstructure after the cooling-down from the austenization temperature.

Silicon increases the scaling resistance during hot forming and inhibits the tendency for oxidation. Therefore, silicon is an alloyed element together with niobium. The content of silicon is limited to less than or equal to 3.5%, preferably less than or equal to 2.0% for avoiding an unnecessary exposure for hot-cracks during welding, but also to bypass unwanted low-melting phases.

Molybdenum is optionally added to the steel of the invention especially when the steel is used for particular corrosive components. Molybdenum together with chromium and nitrogen has an additional high resistance against pitting corrosion. Further, molybdenum increases the strength properties in high temperatures and the steel can then be used in hot forming steels for high temperature solutions, for instance for heat-protection shields.

In case that the austenite phase formers, such as carbon and nitrogen, are limited to use, nickel is added as a strong austenite phase former in order to ensure the creation of residual austenite after hot forming. The same effect can be reached with copper in amounts less than or equal to 2.0%.

Amounts of unwanted accompanying elements such as phosphor, sulphur and hydrogen, are limited to an amount as low as possible. Further, aluminum is limited to less than 0.02% and boron is limited to less than 0.05%.

The steel of the invention is advantageously manufactured by continuous casting or by strip casting. Naturally, any other relevant casting methods can be utilized. After casting the steel is deformed to hot rolled strip or cold rolled plate, sheet or strip or even to a coil with a thickness of less than or equal to 8.0 millimeter, preferably between 0.25 and 4.0 mm. A thermo-mechanical rolling can be included in the manufacturing process of the material in order to speed-up the austenite phase transformation with a result of creating fine-grained microstructure for desired mechanical technological properties. The material of the present invention can have alloy depending different microstructures as a delivery state before the subsequent hot-forming operation in order to manufacture a desired component. After hot-forming the manufactured component has a martensitic microstructure, partially with ductile residual austenite phase.

The component manufactured of hot formed steel of the invention can be used for transportations parts of vehicles, especially for crash-relevant structural parts and chassis components where high strength with defined intrusion level is required in combination with an also high ductility, high energy absorption, high toughness and a good behavior under fatigue conditions. The scaling and corrosion resistance enables applications in wet corrosion areas. Components for buses, trucks, railways or agricultural vehicles are also conceivable for passenger cars. Because of the combination of the alloying elements and the hot-forming process, the steel of the present invention has a high wear resistance what makes it suitable for tools, blades, shredder blades and cutters of cultivation machines in the area of agricultural vehicles. Further, pressure vessels, storages, tanks or tubes are also suitable solutions, for instance the manufacturing of high strength crash safety roll bars is possible. A combination of hydroforming with a subsequent hot forming is suitable to create complex structural parts, such as pillars or cowls. With the pointed out high wear resistance the steel of the invention is additionally suitable for antigraffiti solutions, such as skins of railways, park benches. Further, the hot formable alloy is suitable to use for cutlery because of the fine grained microstructure and thus an additional process step, such as cryogen treatment, can be avoided.

With additional process steps after hot forming, such as polishing or shot-peeling, the steel of the invention can be used for wear-resistant home solutions.

In the manufacturing of a component by hot forming from the steel of the invention the austenization temperature depends on the solution and the necessary solution properties. For high wear resistance solutions an austenization temperature, directly above $A_{c3}$ temperature, alloy-depending between 650° C. and 810° C., is suitable to create wear-resistance, unsolved carbides. For solutions which needs high ductility, energy absorption potential or bendability like structural parts of passenger cars, austenization temperatures with completely solved and homogeneous allocated carbides with a fine microstructure are preferred. Then an austenization temperature between 890° C. and 980° C. is suitable. For solutions under high pressure conditions like storages or pressure vessels, an austenization temperature up to 1200° C. can be necessary to create a finest microstructure without any carbide formation. More preferably the austenization temperature is between 940° C. and 980° C. in solutions for automotive industries. For transport solution typical hot-forming parameter mechanical values result so that the yield strength $R_{p0.2}$ is at the range of 1100-1350 MPa, the tensile strength $R_m$ is at the range of 1600-1750 MPa and the elongation $A_{40x8}$ is at the range of 10-12.5%. The elongation $A_{40x8}$ means that the tensile testing is done using a tensile stave with the length of 40 millimeter and with the width of 8 millimeter.

The steel of the invention was tested with the alloys A-H, and the chemical compositions and the microstructure in the initial state of these alloys are described in the following table 1.

TABLE 1

| Alloy | C | Si | Mn | Cr | Ni | Mo | N | Nb | Microstructure in initial state |
|---|---|---|---|---|---|---|---|---|---|
| A | 0.17 | 0.3 | 3.5 | 10.5 | 6.0 | — | 0.08 | 0.08 | Austenitic - ferritic (Duplex) |
| B | 0.17 | 0.3 | 5.0 | 9.5 | — | — | 0.08 | 0.08 | Martensitic |
| C | 0.17 | 0.3 | 7.0 | 9.5 | — | — | 0.08 | 0.08 | Martensitic |
| D | 0.17 | 0.3 | 3.0 | 12.5 | — | — | 0.08 | 0.08 | Martensitic |
| E | 0.12 | 0.3 | 3.0 | 12.5 | — | — | 0.08 | 0.08 | Martensitic |
| F | 0.12 | 2.0 | 3.0 | 10.5 | — | — | 0.08 | 0.08 | Ferritic |
| G | 0.12 | 0.3 | 2.0 | 12.5 | — | — | 0.08 | 0.18 | Ferritic |
| H | 0.12 | 0.3 | 2.5 | 10.5 | — | — | 0.08 | 0.08 | Ferritic |

The results of the mechanical tests for the hot formed alloys of the steel of the invention are in the following table 2. As an austenization temperature a typical austenization temperature for automotive solutions was used.

TABLE 2

| Alloy | Austenization temperature ° C. | Yield strength $R_{p0.2}$ [MPa] | Tensile strength $R_m$ [MPa] | Elongation $A_{40\times8}$ [%] |
|---|---|---|---|---|
| A | 950 | 1190 | 1700 | 11.8 |
| B | 940 | 1120 | 1620 | 12.3 |
| C | 940 | 1340 | 1690 | 10.3 |
| D | 980 | 1270 | 1710 | 11.0 |
| E | 980 | 1260 | 1640 | 11.3 |
| F | 950 | 1260 | 1560 | 11.3 |

TABLE 2-continued

| Alloy | Austenization temperature ° C. | Yield strength $R_{p0.2}$ [MPa] | Tensile strength $R_m$ [MPa] | Elongation $A_{40\times8}$ [%] |
|---|---|---|---|---|
| G | 950 | 1240 | 1530 | 11.3 |
| H | 950 | 1220 | 1500 | 9.8 |

The results in the table 2 show that for the alloys A-H at the austenization temperature range 940-980° C. the yield strength $R_{p0.2}$ is at the range of 1190-1340 MPa and the tensile strength $R_m$ at the range of 1500-1710 MPa. The elongation $A_{40x8}$ is between 9.8 and 12.3%.

The elongation $A_{80}$ of the alloy F was also tested and in the following table 3 the elongation values for $A_{80}$ and $A_{40x8}$ in the alloy F is compared with each other. Further, the table 3 shows the respective values for the yield strength and the tensile strength.

TABLE 3

| Alloy | Test sample | Yield strength $R_{p0.2}$ [MPa] | Tensile strength $R_m$ [MPa] | Elongation [%] |
|---|---|---|---|---|
| F | $A_{40\times8}$ | 1260 | 1560 | 11.3 |
| | $A_{80}$ | 1247 | 1587 | 9.1 |

The following table 4 contains the minimum and maximum austenization temperatures for the alloys A to H. Also the preferred austenization temperature range is indicated for each alloy A to H.

TABLE 4

| Alloy | Minimum Austenization temperature ° C. | Preferred Austenization temperature range ° C. | Maximum Austenization temperature ° C. |
|---|---|---|---|
| A | 720 | 920-980 | 1200 |
| B | 700 | 910-970 | 1200 |
| C | 670 | 910-970 | 1200 |
| D | 780 | 950-1010 | 1120 |
| E | 800 | 950-1010 | 1100 |
| F | 780 | 920-980 | 1170 |
| G | 830 | 920-980 | 1080 |
| H | 790 | 920-980 | 1180 |

The time which was necessary to reach austenization temperature from room temperature was 95 seconds up to 105 seconds and the resulting heating speed was then 3.5 K/s up to 4.5 K/s. Additionally fast heating technologies like induction reach the same values with heating time between 35 seconds up to 50 seconds and the resulting heating speed between 15K/s up to 25K/s.

Depending on the alloying concept, austenization temperature, the holding time at austenization temperature, cooling procedure, optionally annealing time and annealing temperature, the resulting microstructure after cooling down from austenization temperature can verify between 0.5% up to 44% ductile austenite phase in a martensitic matrix. Without an additionally annealing step, a maximum austenite phase content of 9.5% was identified. Having an additional short-time annealing step (<120 s) the content of the austenite phase increases to a maximum of 28%. The theoretical maximum of the austenite phase content in the microstructure can be reached with a long-time annealing process (30 min): 44%.

The martensitic starting temperatures ($M_S$) for the alloys A-H of the invention are calculated with the formula (% X means the content of the X element in weight %):

$M_S$=550−350% C−40% Mn−20% Cr−17% Ni−10% Cu−10% Mo−35% V−8% W+30% Al+15% Co

The results are enlisted in the following table 5.

TABLE 5

| Alloy | Ms [° C.] |
|---|---|
| A | 38.5 |
| B | 100.5 |
| C | 20.5 |
| D | 120.5 |
| E | 138 |
| F | 178 |
| G | 178 |
| H | 198 |

The table 5 shows that the martensitic starting temperature ($M_s$) is essentially lower than for instance for the steel 22MnB5 where the martensitic starting temperature is between 390° C. and 415° C.

The invention claimed is:

1. A steel having ductile austenitic areas existing in a martensitic matrix, the steel comprising:

in weight % less than or equal to 0.2%, carbon (C), less than or equal to 3.5% silicon (Si), 3.0-16.0% manganese (Mn), 8.0-14.0% chromium (Cr), less than or equal to 6.0% nickel (Ni), less than or equal to 1.0% nitrogen (N), less than or equal to 1.2% niobium (Nb) linked to the formula Nb=4x(C+N), less than or equal to 1.2% titanium (Ti) so that Ti=4x(C+N)+0.15, and further optionally less than or equal to 2.0% molybdenum (Mo), less than or equal to 0.15% vanadium (V), less than or equal to 2.0% copper (Cu), less than 0.2% aluminum (Al), less than or equal to 0.05% boron (B), the remainder comprising iron and evitable impurities; and wherein the yield strength of the steel $R_{p0.2}$ is in the range of 1100-1350 MPa, the tensile strength of the steel $R_m$ is in the range of 1600-1750 MPa, and the elongation of the steel $A_{40x8}$ is in the range of 10-12.5%.

2. The steel according to the claim 1, wherein the steel comprises 0.08-0.18% carbon (C).

3. The steel according to claim 1, wherein the steel comprises less than equal to 2.0% silicon (Si).

4. The steel according to claim 1, wherein the steel comprises 3.0-7.0% manganese (Mn).

5. The steel according to claim 1, wherein the steel comprises 9.5-12.5% chromium (Cr).

6. The steel according to claim 1, wherein the steel comprises less than or equal to 0.8% nickel (Ni).

7. The steel according to claim 1, wherein the steel comprises 0.05-0.6% nitrogen (N).

8. The steel according to claim 1, wherein the steel comprises 0.08-0.25% niobium (Nb) so that Nb=4x(C+N).

9. The steel according to claim 1, wherein the steel comprises 0.3-0.4% titanium (Ti) so that Ti=4x(C+N)+0.15.

10. The steel according to claim 9, wherein the Ti content in the steel is 48/12% C+48/14% N.

11. The steel according to claim 1, wherein the steel comprises optionally 0.5-0.7% molybdenum (Mo).

12. The steel of claim 1, the steel being hot formed after austenization.

* * * * *